US005193798A

United States Patent [19]

Okano

[11] Patent Number: 5,193,798

[45] Date of Patent: Mar. 16, 1993

[54] AUTOMATIC PAPER FEEDER

[75] Inventor: Hiroshi Okano, Yokohama, Japan

[73] Assignee: Matsushita Graphic Communications Systems, Inc., Tokyo, Japan

[21] Appl. No.: 905,987

[22] Filed: Jun. 29, 1992

[30] Foreign Application Priority Data

Sep. 30, 1991 [JP] Japan ..... 3-251097

[51] Int. Cl.[5] ..... B65H 3/52

[52] U.S. Cl. ..... 271/124

[58] Field of Search ..... 271/121, 124, 125

[56] References Cited

U.S. PATENT DOCUMENTS 4,674,737 6/1987 Murayoshi ..... 271/124

4,844,437 7/1989 Tanaka ..... 271/124

*Primary Examiner*—Richard A. Schacher

*Attorney, Agent, or Firm*—Lowe, Price, LeBlanc & Becker

[57] ABSTRACT

Automatic paper feeder includes a feed roller, and a paper-separating member in contact with the feed roller. A push member serves to press the paper-separating member against the feed roller. A spring serves to exert a pressing force on the push member. A mechanism serves to adjust the pressing force of the spring which is exerted on the push member. The spring-force adjusting mechanism includes a swingable adjustment plate connected to the spring, a cam, and a movable adjustment member connected to the adjustment plate via the cam. The adjustment member has a knob. At least a part of the knob is exposed to be easily accessed. The pressing force of the spring which is exerted on the push member is varied in accordance with a position of the knob.

6 Claims, 3 Drawing Sheets

AUTOMATIC PAPER FEEDER

BACKGROUND OF THE INVENTION

This invention relates to an automatic paper feeder which can be used in various apparatuses such as facsimile machines and copying machines.

Most of facsimile machines and copying machines have an automatic paper feeder. As will be explained later, prior-art automatic paper feeders have some problems.

SUMMARY OF THE INVENTION

It is an object of this invention to provide an improved automatic paper feeder.

A first aspect of this invention provides an automatic paper feeder comprising a feed roller; a paper-separating member in contact with the feed roller; a push member for pressing the paper-separating member against the feed roller; a spring for exerting a pressing force on the push member; and means for adjusting the pressing force of the spring which is exerted on the push member; wherein the spring-force adjusting means comprises a swingable adjustment plate connected to the spring, a cam, and a movable adjustment member connected to the adjustment plate via the cam, the adjustment member having a knob, wherein at least a part of the knob is exposed to be easily accessed, and wherein the pressing force of the spring which is exerted on the push member is varied in accordance with a position of the knob.

A second aspect of this invention provides an automatic paper feeder comprising a feed roller; a paper-separating member; means for pressing the paper-separating member against the feed roller, the pressing means comprising a spring for exerting a pressing force on the paper-separating member; and means for adjusting the pressing force of the spring which is exerted on the paper-separating member; wherein the adjusting means comprises a first movable adjustment member connected to the spring, a cam, and a second movable adjsutment member connected to the first adjustment member via the cam, wherein at least a part of the second adjustment member is exposed to be easily accessed, and wherein the pressing force of the spring which is exerted on the paper-separating member is varied in accordance with a position of the second adjustment member.

DESCRIPTION OF THE PRIOR ART

Figure 1:
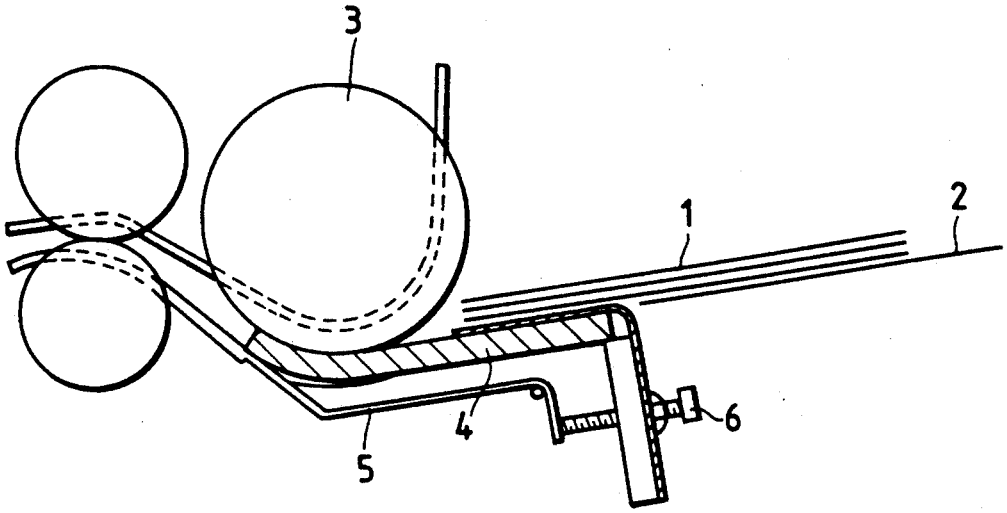
FIG. 1 PRIOR ART
FIG. 1 is a sectional view of a prior-art automatic paper feeder.

FIG. 1 shows a prior-art automatic paper feeder. In the prior-art automatic paper feeder of FIG. 1, document papers 1 are stacked and placed on a document rack 2. A feed roller 3 is located at an end of the document rack 2. A paper-separating member 4 is pressed against the feed roller 3 by a leaf spring 5. The separating member 4 is composed of, for example, a rubber plate. By rotating an adjustment screw 6 engaging the leaf spring 5, adjustment is given of the force of the leaf spring 5 which presses the separating member 4 against the feed roller 3.

Edges of the document papers 1 are set into a region between the feed roller 3 and the separating member 4. The document papers 1 are sequentially separated by the separating member 4, and are sequentially moved into engagement with the feed roller 3. The feed roller 3 is rotated by a suitable drive device (not shown). The document papers 1 are sequentially fed to a later stage by the feed roller 3.

The characteristics of separating the document papers 1 depend on the level of the force of the leaf spring 5 which presses the separating member 4 against the feed roller 3. Sine the force of the leaf spring 5 varies in accordance with the position of the adjustment screw 6, the characteristics of separating the document papers 1 are adjusted by rotating the adjustment screw 6. The adjustment of the force of the leaf spring 5 by the adjustment screw 6 is continuous (stepless). Thus, the user tends to be required to carefully rotate the adjustment screw 6 during the adjustment of the force of the leaf spring 5. In addition, the user tends to be worry whether or not good adjustment has been done.

The adjustment screw 6 is usually located in a deep region within a related apparatus (such as a related facsimile machine), so that access to the adjustment screw 6 is not easy.

Figure 2:
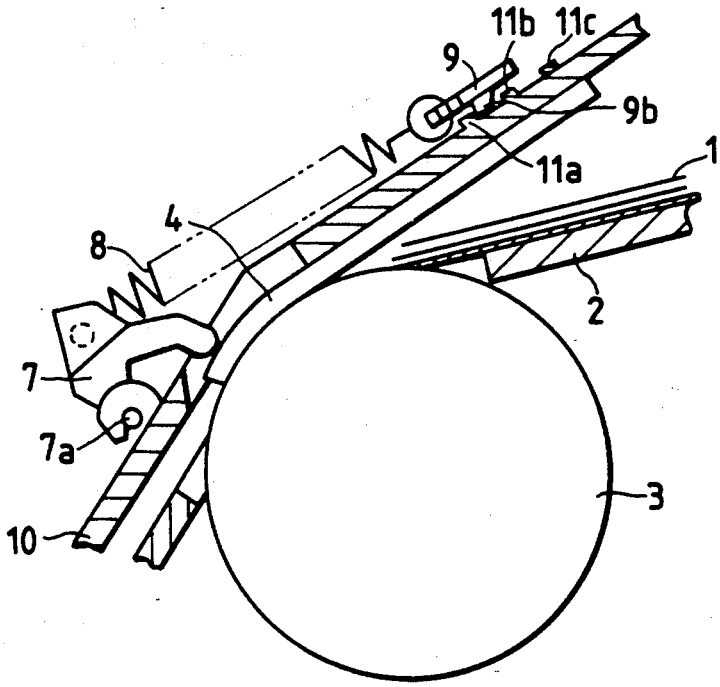
FIG. 2 PRIOR ART
FIG. 2 is a sectional view of another prior-art automatic paper feeder.
Figure 3:
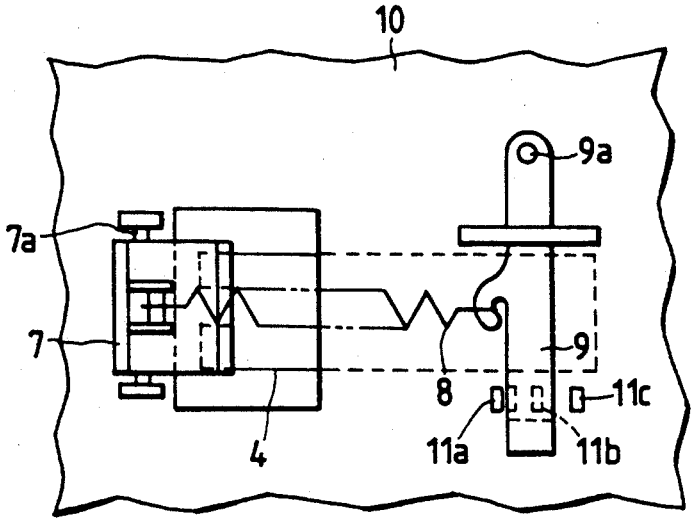
FIG. 3 PRIOR ART
FIG. 3 is a top view of the prior-art automatic paper feeder of FIG. 2.

FIGS. 2 and 3 show another prior-art automatic paper feeder which is disclosed in Japanese published unexamined patent application 3-56337. In the prior-art automatic paper feeder of FIGS. 2 and 3, document papers 1 are stacked and placed on a document rack 2. A feed roller 3 is located at an end of the document rack 2. A paper-separating member 4 is pressed against the feed roller 3 by a pressing mechanism described later. The separating member 4 is composed of, for example, a rubber plate. The pressing mechanism includes a push member 7 swingable (rotatable) about a shaft 7*a*. The push member 7 has a projecting end contacting the separating member 4. One end of a spring 8 is connected to the push member 7, and the other end of the spring 8 is connected to an adjustment member 9. The spring 8 urges the push member 7 toward the separating member 4, pressing the separating member 4 against the feed roller 3.

The adjustment member 9 can swing (rotate) about a shaft 9*a*. The adjustment member 9 has a pawl 9*b* at a position well remote from the shaft 9*a*. The pawl 9*b* of the adjustment member 9 can engage one of hooks 11*a*, 11*b*, and 11*c* formed on a fixed upper paper guide 10. The adjustment member 9 can be fixed at either of three different positions which correspond to the positions of the hooks 11*a*, 11*b*, and 11*c* respectively. In other words, the position of the adjustment member 9 can be changed among the three stable positions. The force of the spring 8 which presses the separating member 4 against the feed roller 3 depends on the position of the adjustment member 9. Thus, the force of the spring 8 is changed among three different levels as the position of the adjustment member 9 is changed among the three stable positions. In this way, the force of the spring 8 which presses the separating member 4 against the feed roller 3 can be adjusted in a stepwise manner. Generally, the stepwise adjustment can be easily executed by the user.

The adjustment member 9 is usually located in a deep region within a related apparatus (such as a related facsimile machine), so that access to the adjustment member 9 is not easy.

DESCRIPTION OF THE PREFERRED EMBODIMENT

Figure 4:
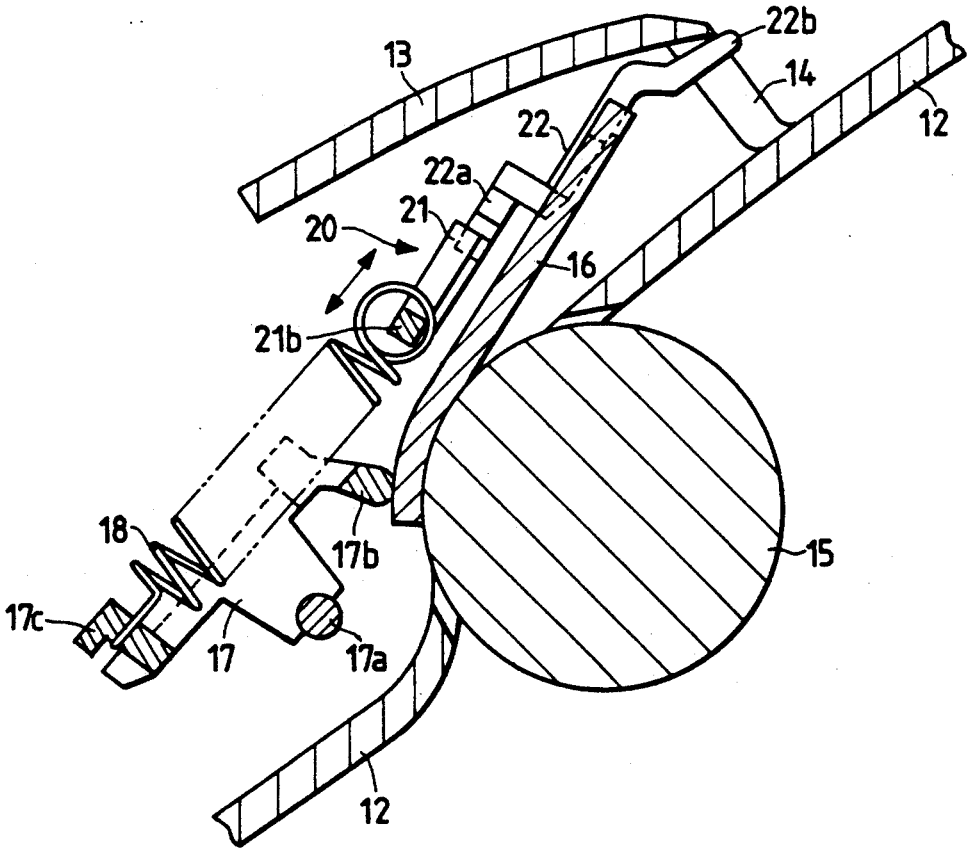
FIG. 4 is a sectional view of an automatic paper feeder according to an embodiment of this invention.
Figure 5:
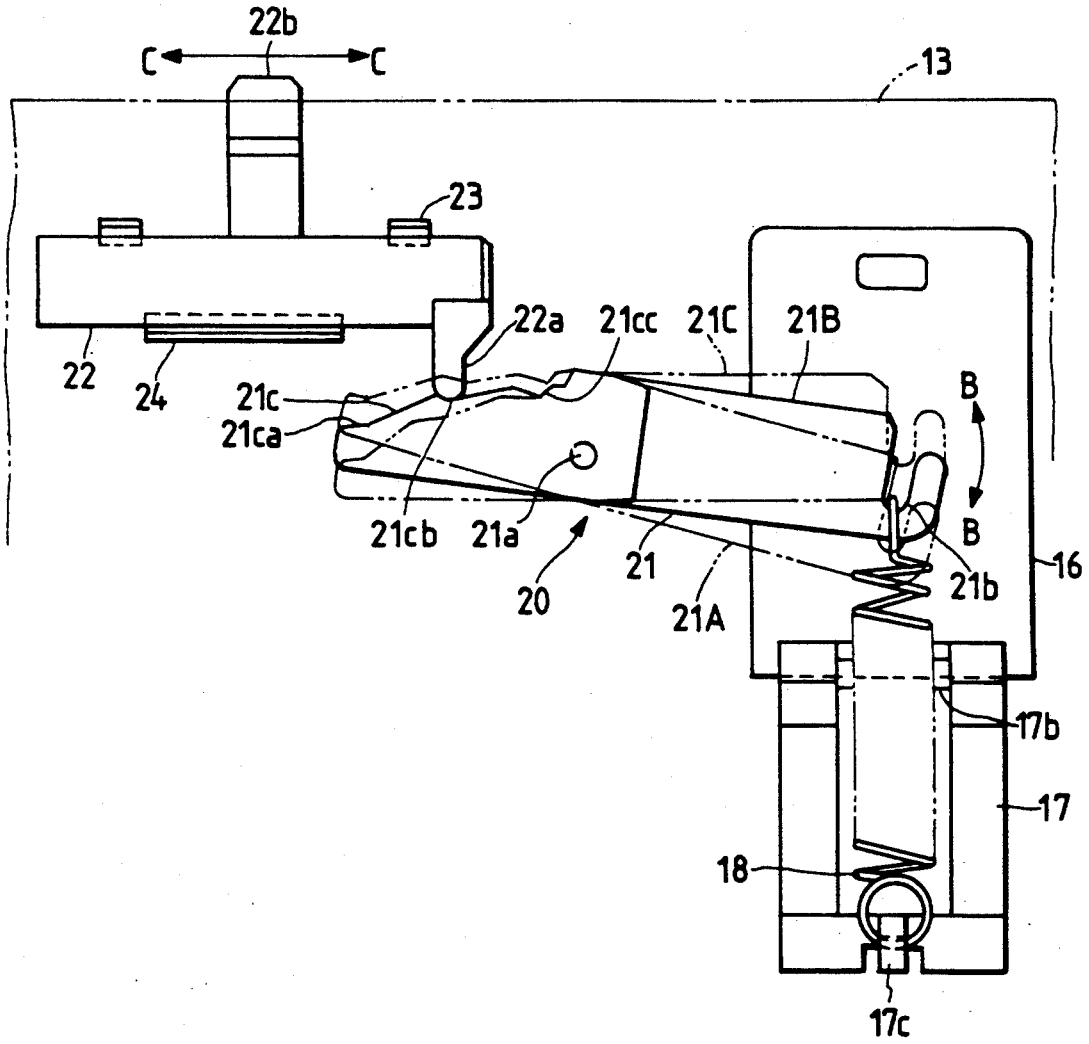
FIG. 5 is a top view of a portion of the automatic paper feeder of FIG. 4.

With reference to FIGS. 4 and 5, an automatic paper feeder of a facsimile machine includes a lower paper guide 12 having a portion serving as a document rack on which document papers (not shown) are placed. During a feeding process, the document papers are guided by a pair of the lower paper guide 12 and an upper paper guide (not shown). The facsimile machine has an upper cover 13 extending above the lower paper guide 12. A document insertion opening 14 is defined between the facsimile-machine upper cover 13 and the lower paper guide 12.

The lower paper guide 12 has an opening through which a feed roller 15 extends. The feed roller 15 is rotated by a suitable drive device (not shown). A paper-separating member 16 is pressed against the feed roller 15 by a pressing mechanism which will be explained later. The separating member 16 is composed of, for example, a rubber plate. The separating member 16 is swingably (rotatable) connected to the upper paper guide (not shown).

The pressing mechanism includes a push member 17 swingably (rotatably) connected to the upper paper guide (not shown). Specifically, the push member 17 can swing (rotate) about a shaft 17*a*. The push member 17 has opposite ends 17*b* and 17*c*. The end 17*b* of the push member 17 contacts the separating member 16. The other end 17*c* includes a projection engaging a first end of a spring 18. The spring 18 urges the push member 17 in a clockwise direction as viewed in FIG. 4, forcing the end 17*b* of the push member 17 toward the separating member 16 and thereby pressing the separating member 16 against the feed roller 15.

A mechanism 20 for adjusting the force of the spring 18 includes an adjustment plate 21 and an adjustment member 22. The adjustment plate 21 is swingably (rotatably) supported on the upper paper guide (not shown). Specifically, the adjustment plate 21 can swing (rotate) about a shaft 21*a* in directions denoted by the arrows B of FIG. 5. The adjustment plate 21 has opposite ends between which the shaft 21*a* is located. One end of the adjustment plate 21*a* has a hook engaging a second end of the spring 18. The other end of the adjustment plate 21 has a cam surface 21*c*. The adjustment member 22 is slidably supported by fixed guide members 23 and 24. The adjustment member 22 can move in directions denoted by the arrows C of FIG. 5. An end of the adjustment member 22 has a projection 22*a* engaging the cam surface 21*c* of the adjustment plate 21. As the adjustment member 22 moves in the directions C of FIG. 5, the engagement projection 22*a* of the adjustment member 22 slides along the cam surface 21*c* of the adjustment plate 21 so that the adjustment plate 21 swings (rotates) in the directions B of FIG. 5 in accordance with the profile of the cam surface 21*c*.

As the adjustment plate 21 swings (rotates) in the directions B of FIG. 5, the spring 18 expands or contracts. Thus, the force of the spring 18 which presses the separating member 16 against the feed roller 15 depends on the angular position of the adjustment plate 21. Since the adjustment plate 21 swings (rotates) in accordance with movement of the adjustment member 22, the force of the spring 18 is varied by moving the adjustment member 22 in the directions C of FIG. 5. In this way, the force of the spring 18 which presses the separating member 16 against the feed roller 15 depends on the position of the adjustment member 22.

The cam surface 21*c* of the adjustment plate 21 has recesses 21*ca*, 21*cb*, and 21*cc* spaced at approximately equal intervals. The engagement projection 22*a* of the adjustment member 22 can be stably held in either of the recesses 21*ca*, 21*cb*, and 21*cc*. Thus, the recesses 21*ca*, 21*cb*, and 21*cc* provide respective stable positions of the adjustment member 22 and the adjustment plate 21. Specifically, there are three different positions at which the adjustment member 22 can be stably held. In addition, there are three corresponding positions 21A, 21B, and 21C at which the adjustment plate 21 can be stably held. The force of the spring 18 is changed among three different levels as the position of the adjustment member 22 is changed among the three stable positions. In this way, the force of the spring 18 which presses the separating member 16 against the feed roller 15 can be adjusted in a stepwise manner. Generally, the stepwise adjustment can be easily executed by the user.

A knob 22*b* attached to the adjustment member 22 extends through the document insertion opening 14, and an end of the knob 22*b* emerges outward from the facsimile-machine upper cover 13. In other words, the end of the knob 22*b* is exposed so that access to the knob 22*b* is easy. Thus, during adjustment of the force of the spring 18 which presses the separating member 16 against the feed roller 15, the user can easily move the adjustment member 22 by handling the knob 22*b*. An area of the outer surface of the facsimile-machine upper cover 13 which extends near the knob 22*b* has position reference marks for the knob 22*b*.

Document papers (not shown) are inserted into the automatic paper feeder via the document insertion opening 14, and are placed on the paper-rack portion of the lower paper guide 12. Edges of the document papers are set into a region between the feed roller 15 and the separating member 16. The document papers are sequentially separated by the separating member 16, and are sequentially moved into engagement with the feed roller 15. The document papers are sequentially fed to a later stage by the feed roller 15.

The above-mentioned parts are designed so that the force of the spring 18 which presses the separating member 16 against the feed roller 15 will be essentially optimized when the engagement projection 22*a* of the adjustment member 22 falls into the intermediate recess 21*cb* in the cam surface 21*c* of the adjustment plate 21. Thus, during the assembly of the facsimile machine including the automatic paper feeder, the knob 22*b* is set in a position at which the engagement projection 22*a* of the adjustment member 22 fits into the intermediate recess 21*cb* in the cam surface 21*c* of the adjustment plate 21. Abrasion and ageing of the parts vary the conditions determining the optical force of the spring 18. In addition, the optimal force of the spring 18 depends on conditions of document papers. The user can easily re-optimize the force of the spring 18 by handling the knob 22*b* to move the engagement projection 22*a* of the adjustment member 22 into the end recess 21*ca* or 21*cc* in the cam surface 21*c* of the adjustment plate 21.

What is claimed is:

1. An automatic paper feeder comprising:

a feed roller;

a paper-separating member in contact with the feed roller;

a push member for pressing the paper-separating member against the feed roller;

a spring for exerting a pressing force on the push member; and means for adjusting the pressing force of the spring which is exerted on the push member;

wherein the spring-force adjusting means comprises a swingable adjustment plate connected to the spring, a cam, and a movable adjustment member connected to the adjustment plate via the cam, the adjustment member having a knob, wherein at least a part of the knob is exposed to be easily accessed, and wherein the pressing force of the spring which is exerted on the push member is varied in accordance with a position of the knob.

2. The automatic paper feeder of claim 1, wherein the cam comprises a cam surface formed on the adjustment plate, and a projection formed on the adjustment member and engaging the cam surface.

3. The automatic paper feeder of claim 2, wherein the cam surface has a plurality of recesses in which the projection on the adjustment member can be stably held.

4. An automatic paper feeder comprising:

a feed roller;

a paper-separating member;

means for pressing the paper-separating member against the feed roller, the pressing means comprising a spring for exerting a pressing force on the paper-separating member; and means for adjusting the pressing force of the spring which is exerted on the paper-separating member;

wherein the adjusting means comprises a first movable adjustment member connected to the spring, a cam, and a second movable adjustment member connected to the first adjustment member via the cam, wherein at least a part of the second adjustment member is exposed to be easily accessed, and wherein the pressing force of the spring which is exerted on the paper-separating member is varied in accordance with a position of the second adjustment member.

5. The automatic paper feeder of claim 4, wherein the cam comprises a cam surface formed on the first adjustment member, and a projection formed on the second adjustment member and engaging the cam surface.

6. The automatic paper feeder of claim 5, wherein the cam surface has a plurality of recesses in which the projection on the second adjustment member can be stably held.

* * * * *

UNITED STATES PATENT AND TRADEMARK OFFICE

CERTIFICATE OF CORRECTION

PATENT NO. : 5,193,798
DATED : March 16, 1993
INVENTOR(S) : Hiroshi Okano

It is certified that error appears in the above-indentified patent and that said Letters Patent is hereby corrected as shown below:

On title page, item [73] should read as follows:

Matsushita Graphic [Communications] Communication Systems, Inc.

Signed and Sealed this
Twelfth Day of April, 1994

Bruce Lehman

BRUCE LEHMAN
*Commissioner of Patents and Trademarks*

*Attest:*

*Attesting Officer*